US008698585B2

(12) United States Patent
Takiguchi et al.

(10) Patent No.: US 8,698,585 B2
(45) Date of Patent: Apr. 15, 2014

(54) HIGH POWER INDUCTANCE DEVICE

(75) Inventors: Takashi Takiguchi, Tokyo (JP); Yuko Kanazawa, Tokyo (JP); Mikio Kitaoka, Tokyo (JP); Satoshi Ota, Tokyo (JP)

(73) Assignee: FDK Corporation, Tokyo (JP)

( * ) Notice: Subject to any disclaimer, the term of this patent is extended or adjusted under 35 U.S.C. 154(b) by 124 days.

(21) Appl. No.: 13/395,233

(22) PCT Filed: Sep. 6, 2010

(86) PCT No.: PCT/JP2010/005455

§ 371 (c)(1),
(2), (4) Date: Mar. 9, 2012

(87) PCT Pub. No.: WO2011/030531

PCT Pub. Date: Mar. 17, 2011

(65) Prior Publication Data

US 2012/0169443 A1 Jul. 5, 2012

(30) Foreign Application Priority Data

Sep. 11, 2009 (JP) ..... 2009-211029

(51) Int. Cl.
*H01F 27/08* (2006.01)

(52) U.S. Cl.
USPC ..... 336/61

(58) Field of Classification Search
USPC ..... 336/55–62, 233–234, 178, 212
See application file for complete search history.

(56) References Cited

FOREIGN PATENT DOCUMENTS

| | | |
|---|---|---|
| JP | 58-12915 | 1/1983 |
| JP | 2003-188033 | 7/2003 |
| JP | 2005-228858 | 8/2005 |
| JP | 2006-319312 | 11/2006 |
| JP | 2008-41721 | 2/2008 |

OTHER PUBLICATIONS

International Search Report issued Dec. 14, 2010 in International (PCT) Application No. PCT/JP2010/005455.

*Primary Examiner* — Tuyen Nguyen
(74) *Attorney, Agent, or Firm* — Wenderoth, Lind & Ponack, L.L.P.

(57) ABSTRACT

A high power inductance device enables a large ferrite magnetic core to be manufactured at low cost and with ease and improves heat radiation efficiency to reduce an increase in the temperature of the core. The inductance device has a ferrite magnetic core and a winding wire wound around the ferrite magnetic core and is mounted on a heat radiation structure through at least one of the front surfaces of the ferrite magnetic core. The ferrite magnetic core is made of a core aggregate obtained by arranging side by side a plurality of ferrite cores 10 having a completely-closed magnetic path structure or a quasi-closed magnetic path structure with a magnetic gap such that an interval is placed between the ferrite cores and magnetic paths are parallel to each other. The inductance device is mounted such that at least one plane surface of the peripheral surfaces of each of the ferrite cores is brought into direct or indirect contact with the heat radiation structure 18 with a metal plate 12 inserted into the interval between the ferrite cores and the common winding wire 14 wound around all the ferrite cores.

5 Claims, 4 Drawing Sheets

HIGH POWER INDUCTANCE DEVICE

TECHNICAL FIELD

The present invention relates to large inductance devices through which a large current flows, and more specifically, to a high power inductance device in which a ferrite magnetic core forming magnetic paths is made of a core aggregate obtained by arranging a plurality of ferrite cores side by side such that an interval is placed between the ferrite cores and the magnetic paths are parallel to each other and in which a metal plate is inserted into each of the intervals between the ferrite cores to increase a heat path cross-sectional area and improve heat transfer efficiency to a heat radiation structure, thereby reducing a temperature increase. This technology is particularly useful for in-vehicle (car-mounted) transformers, coils, or the like having a high power capacity.

BACKGROUND ART

In-vehicle DC/DC converters require a transformer and a coil, which operate with a large current. Such high power inductance devices use ferrite as a magnetic core material because they are expected to operate at high frequency ranges. However, ferrite is likely to be magnetically saturated because its saturation magnetic flux density is not so high. Therefore, a large magnetic path cross-sectional area must be ensured, which necessarily causes a ferrite magnetic core to be upsized and increases a heating value due to a large current flowing through a winding wire.

As is well known, the temperatures of various electronic devices increase with heat generated when the devices are operated, and components are damaged or degraded if such increases in the temperatures greatly exceed the heat resistant temperatures of materials forming the components. Large inductance devices operating with a large current have a high heating value and thus are subjected to measures against heat (see, for example, Patent Literature 1, or the like) in which a part of a ferrite magnetic core is brought into contact with a heat radiation structure such as a housing, a printed board, and a heat radiation plate either in a direct manner, in an indirect manner through a material such as an adhesive, or in a pseudo-contact manner with a minute air gap placed therebetween to release most of generated heat to the heat radiation structure via the ferrite magnetic core.

With such a method, a temperature on the side of the cooling surface (on the side of the surface opposing the heat radiation structure) of the ferrite magnetic core is lowered. However, because ferrite typically has low heat conductivity, the temperature of a part away from the cooling surface is not lowered as much as the side of the cooling surface and thus a considerable temperature difference occurs. The larger the ferrite magnetic core, the longer the length of a heat flow path becomes. Therefore, the heat resistance of the ferrite magnetic core becomes high, which increases the temperature difference between the part away from the cooling surface and a part near the cooling surface. Particularly for the high power large inductance device, it is difficult to prevent a temperature increase in the part away from the cooling surface due to its high heating value.

Next, there is typically a problem in mass-producing large ferrite magnetic cores with excellent dimensional accuracy because ferrite is a sintered body. The larger a ferrite magnetic core, the more the deformation of the ferrite magnetic core such as warpage is likely to occur when the ferrite magnetic core is burnt. In an extreme case, cracks, or the like may occur in the ferrite magnetic core, which causes the degradation of a manufacturing yield. In view of this, there has also been proposed a method (see, for example, Patent Literature 2) in which a large ferrite magnetic core is made of an aggregate of a plurality of relatively small cores. With this method, the plurality of ferrite cores are arranged side by side in a close contact state such that magnetic paths are parallel to each other, thereby obtaining a required magnetic path cross-sectional area.

However, when the ferrite cores are bonded together in the close contact state, they are made to collide with each other by excessive stress, vibration, or the like resulting from heat deformation caused when they are operated. Consequently, problems such as core cracks and in an extreme case core breaking may occur, which leads to a lack in reliability.

Accordingly, it is requested that a problem in the temperature increase of a ferrite magnetic core accompanied by a high power capacity and a problem such as the degradation of productivity and reliability accompanied by the upsizing of the ferrite magnetic core be solved by conventional technologies at the same time. However, such problems still remain.

CITATION LIST

Patent Literature

Patent Literature 1: Japanese Patent Laid-Open No. 2003-188033

Patent Literature 2: Japanese Patent Laid-Open No. 2005-228858

SUMMARY OF INVENTION

Problems to be solved by the present invention are to enable a large ferrite magnetic core of a high power inductance device to be manufactured at low cost and with ease and improve heat radiation efficiency to reduce an increase in the temperature of the core, so that reliability is improved.

The present invention provides a high power inductance device that has a ferrite magnetic core and a winding wire wound around the ferrite magnetic core and is mounted on a heat radiation structure through at least one of the front surfaces of the ferrite magnetic core, wherein the ferrite magnetic core is made of a core aggregate obtained by arranging side by side a plurality of ferrite cores having a completely-closed magnetic path structure or a quasi-closed magnetic path structure with a magnetic gap such that an interval is placed between the ferrite cores and magnetic paths are parallel to each other, and wherein the inductance device is mounted such that at least one plane surface of the peripheral surfaces of each of the ferrite cores is brought into direct or indirect contact with the heat radiation structure with a metal plate inserted into the interval between the ferrite cores and the common winding wire wound around all the ferrite cores. Note that the expression "high power" in the present invention denotes a power capacity of several kW or more and typically a power capacity on the order of several kW to ten and several kW.

Here, each of the ferrite cores is preferably made of a combination of partial cores having bonding surfaces each traversing the magnetic paths. In this case, it is so structured that at least one of the partial cores constituting each of the ferrite cores is an E-shaped core and the other thereof is the E-shaped core or an I-shaped core, and the winding wire is wound around the middle leg part of the E-shaped core. Alternatively, at least one of the partial cores constituting each of the ferrite cores may be a U-shaped core and the other thereof may be the U-shaped core or the I-shaped core.

Here, the metal plate is, for example, a flat plate having the same shape as that of the side surface of the ferrite core opposing the metal plate. Alternatively, the metal plate may be a comb-shaped flat plate corresponding to the shape of the side surface of the ferrite core. Besides, the metal plate may be a flat plate in which a comb-shaped insertion part corresponding to the shape of the side surface of the ferrite core opposing the metal plate is integrated with an extending part where a part of a peripheral part other than a part near the heat radiation structure extends from the periphery of the ferrite core.

In the high power inductance device according to the present invention, the ferrite magnetic core is made of the aggregate of the plurality of ferrite cores. Therefore, each of the ferrite cores may be relatively small, which improves a manufacturing yield and enables the ferrite magnetic core to be manufactured with ease and at low cost. The plurality of ferrite cores are arranged side by side such that the interval is placed between the ferrite cores and thus are not brought into direct contact with each other. Therefore, the ferrite cores are not made to collide with each other by heat deformation, vibration, or the like caused when they are operated. Consequently, problems such as core cracks and core breaking can be avoided.

Further, the plurality of ferrite cores are configured to be arranged side by side such that the magnetic paths are parallel to each other. Therefore, a required magnetic path cross-sectional area can be ensured with an increase in the number of the cores, which can flexibly deal with product specifications. Moreover, according to the present invention, a substantial heat path cross-sectional area increases with the insertion of the metal plate into each of the intervals between the ferrite cores, which can efficiently radiate generated heat from the cores to the heat radiation structure and reduce an increase in the temperature of the core. Note that because the metal plate is inserted into the interval between the ferrite cores, the existing interval can be put to effective use, which eliminates the likelihood of the device being excessively upsized.

Thus, according to the present invention, the increase in the temperature of the ferrite core can be minimized even if a heating value becomes larger, which is extremely effective in that particularly the downsizing and the cost reduction of the high power inductance device are attained.

DESCRIPTION OF EMBODIMENTS

Figure 1A:
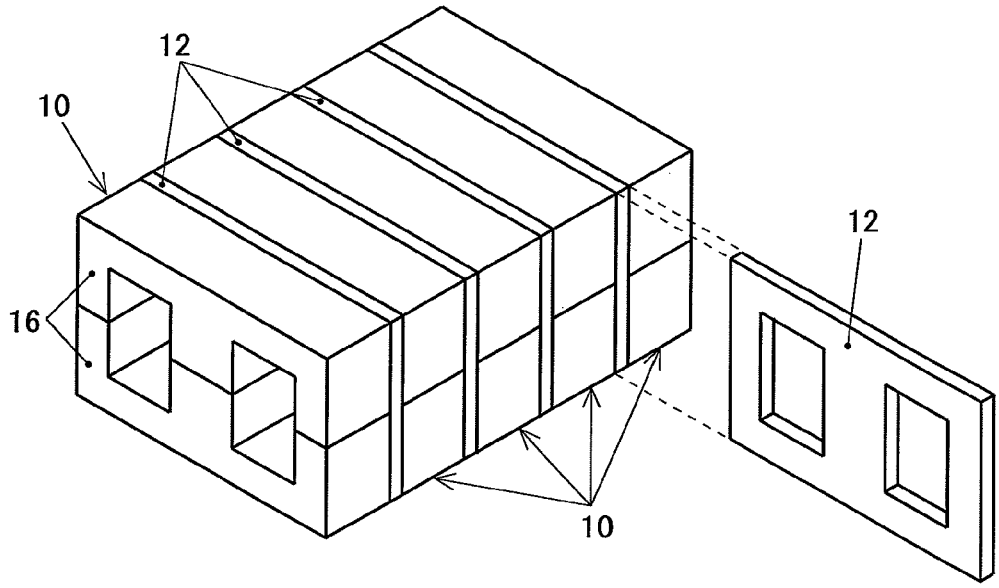
FIG. 1A is an explanatory view illustrating an embodiment of a high power inductance device according to the present invention and is a perspective view of ferrite magnetic core.
Figure 1B:
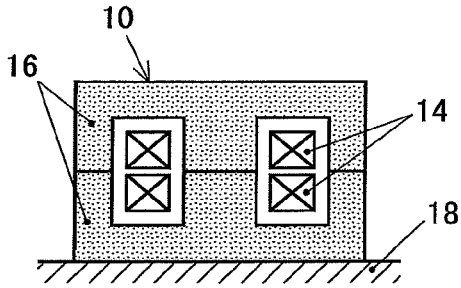
FIG. 1B is a view similar to FIG. 1A but illustrating a state as seen from the side surface of a ferrite core.
Figure 1C:
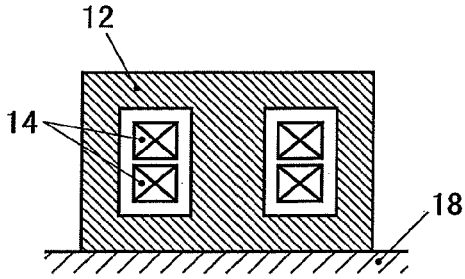
FIG. 1C is a view similar to FIG. 1A but illustrating a state as seen from the front surface of a metal plate.

FIG. 1A to FIG. 1C illustrate an embodiment of a high power inductance device according to the present invention. This inductance device is a high power transformer or a coil having a power capacity on the order of several kW to ten and several kW and includes a ferrite magnetic core and a winding wire wound around the ferrite magnetic core. FIG. 1A is a perspective view of the ferrite magnetic core, FIG. 1B illustrates a state as seen from the side surface of a ferrite core, and FIG. 1C illustrates a state as seen from the front surface of a metal plate. According to the present invention, as illustrated in FIG. 1A, the ferrite magnetic core is so structured as to be made of a core aggregate obtained by arranging a plurality (five in FIG. 1A) of the ferrite cores 10 side by side such that an interval is placed between the ferrite cores and magnetic paths are parallel to each other and so structured as to have the metal plate 12 inserted into each of the intervals between the ferrite cores. Further, as illustrated in FIG. 1B or FIG. 1C, the ferrite magnetic core is so structured as to have the common winding wire 14 wound around all the ferrite cores.

Each of the ferrite cores 10 is made of a combination of partial cores having bonding surfaces each traversing the magnetic paths. Here, both of the partial cores are E-shaped cores 16 and combined such that the tip end surfaces of the leg parts of both the E-shaped cores 16 are brought into close contact with each other in an opposed state to form the completely-closed magnetic paths. Further, the winding wire is wound around the middle leg parts of the E-shaped cores 16. Of course, the partial cores may be made of a combination of the E-shaped core on one side and an I-shaped core on the other side. As a core material, Mn-based ferrite is, for example, used. The metal plate 12 is a flat plate having the same shape as that of the side surface of the opposed ferrite core and preferably an aluminum plate. Alternatively, a copper plate, or the like may be used. In this embodiment, the inductance device is mounted such that each of the ferrite cores is brought into direct or indirect contact with the heat radiation structure 18 with the under surface of the ferrite core and the lower end surface of the metal plate being flush with each other. The heat radiation structure 18 is, for example, a housing, a printed board, a heat radiation plate, or the like.

According to the present invention, each of the ferrite cores 10 and the metal plate 12 are not necessarily brought into close contact with each other. Even if there is a slight interval between them, sufficient heat transfer performance can be exhibited. The ferrite core and the metal plate may be bonded together either in a pinpoint manner or in a surface-contact manner using a soft adhesive such as a silicone-based material. Note that the metal plate is arranged parallel to the magnetic paths formed by the ferrite core and does not interlink with a magnetic flux. Therefore, the existence of the metal plate does not cause an electromagnetic loss.

As is well known, when there is a heat flux $\Phi$ in a member (cross-sectional area S×length L), a temperature difference $\Delta T$ occurs between both ends of the member. The temperature difference $\Delta T$ is expressed by the formula $\Delta T \propto L/S \cdot \lambda \cdot \Phi$ (where $\lambda$: heat conductivity), is inversely proportional to the cross-sectional area S, and is proportional to the heat conductivity $\lambda$. When Mn-based ferrite and metal are compared with each other as heat flow path materials, the metal has heat conductivity about 5 to 40 times as large as the ferrite. Therefore, the temperature difference between the ferrite and the metal becomes 1/5 to 1/40 when they are compared with each other under a member having the same dimension. For example, when the metal member has heat conductivity 10 times as large as the Mn-based ferrite core, the metal member has about the same temperature difference as that of the ferrite member even if it has a heat path cross-sectional area 1/10 of that of the metal member. For this reason, when the metal plate is arranged near the side surface of the ferrite core, even the metal plate having a thickness of 1/10 of that of the ferrite core has about the same heat path cross-sectional area on a ferrite core basis. Therefore, the ferrite core and the metal plate provide together a heat path cross-sectional area substantially twice as large as the single core.

Accordingly, heat generated when the inductance device is driven by the energization of a large current to the winding wire is transferred to the heat radiation structure not only through the ferrite core in a direct manner but also from the ferrite core through the metal plate. The combination of such actions greatly reduces the temperature of the core. Even if the ferrite core and the metal plate are not brought into close contact with each other, heat is transferred if they are adjacently arranged. Consequently, a required cooling effect is obtained.

Figure 2A:
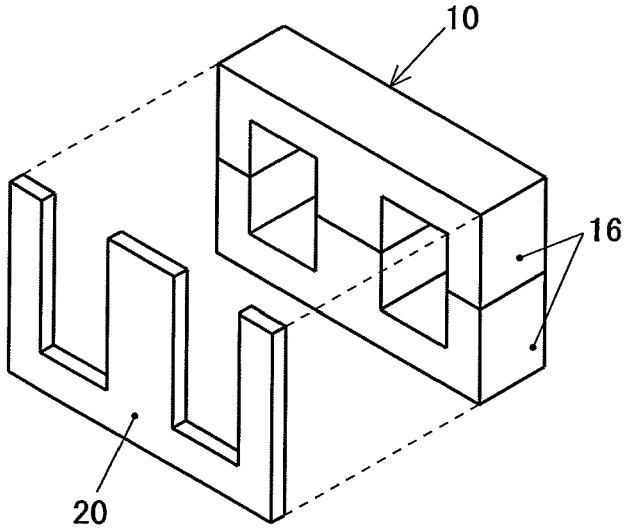
FIG. 2A is an explanatory view of another embodiment of the present invention and is a view illustrating the shapes of the ferrite core and a metal plate.
Figure 2B:
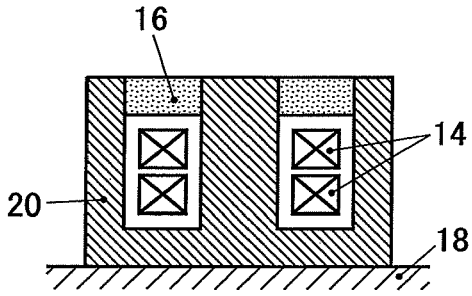
FIG. 2B is a view similar to FIG. 2A but illustrating a state as seen from the front surface of the metal plate.

FIG. 2A and FIG. 2B illustrate another embodiment of the present invention. FIG. 2A illustrates the shapes of the ferrite core 10 and a metal plate 20. The ferrite core has a shape in which the two E-shaped cores 16 are combined with each other to form completely-closed magnetic paths as in FIG. 1A to FIG. 1C. On the other hand, the metal plate 20 is formed into a comb shape corresponding to the shape of the side surface of the ferrite core. In other words, the metal plate has such a comb shape as to be brought into contact with the heat radiation structure 18 with its lower part made common to the ferrite core and upwardly extend from the common lower part to the upper end part of the ferrite core so as to correspond to the middle leg parts and the both-sided leg parts of the ferrite core. FIG. 2B illustrates a state as seen from the front surface of the metal plate 20. Such a comb shape of the metal plate 20 causes a cooling effect to be ruined to some extent due to its slightly degraded heat transfer performance but does not require a wire rod to be penetrated into the rectangular holes of the metal plate, which offers the advantages that a winding operation becomes easy and even a molded winding wire can be attached.

Figure 3A:
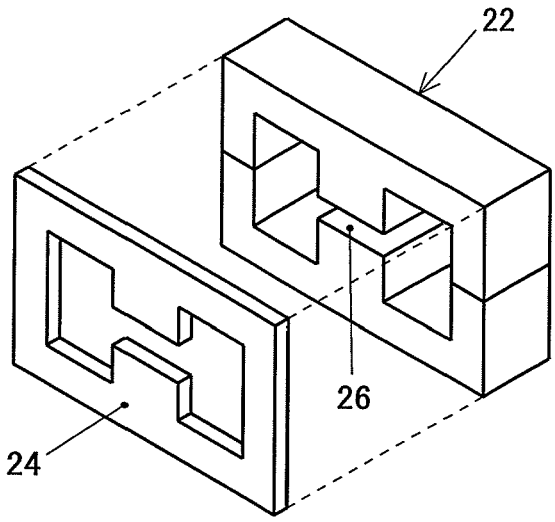
FIG. 3A is an explanatory view of still another embodiment of the present invention and is a view illustrating the shapes of a ferrite core and a metal plate.
Figure 3B:
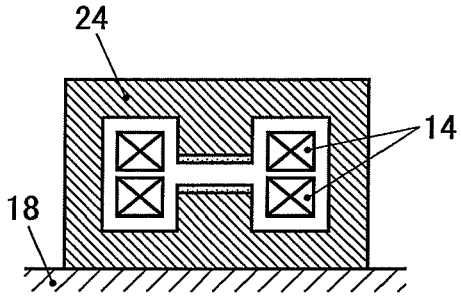
FIG. 3B is a view similar to FIG. 3A but illustrating a state as seen from the front surface of the metal plate.

FIG. 3A to FIG. 3B illustrate still another embodiment of the present invention. FIG. 3A illustrates the shapes of a ferrite core 22 and a metal plate 24. The ferrite core is made of a combination of an E-shaped core and an E-shaped core, both of which have a short middle leg part. Because of this, the ferrite core has a quasi-closed magnetic path structure in which a magnetic gap 26 is formed between the end surfaces of the middle leg parts opposed when the E-shaped cores are combined with each other. Ferrite may form a magnetic gap to prevent magnetic saturation because it has a low saturation magnetic flux density and is thus likely to be magnetically saturated. In a case where a magnetic gap is formed in a magnetic path, the existence of a metal plate near the magnetic gap causes an eddy current to occur with a leakage magnetic flux interlinking with the metal plate, and the metal plate is heated by the eddy current. In view of this, in order to prevent a leakage magnetic flux from interlinking with the metal plate, the central part of the metal plate 24 is cut away to cause the metal plate to have substantially the same shape as that of the opposed ferrite core and cause a part near the magnetic gap to be free from the metal. FIG. 3B illustrates a state as seen from the front surface of the metal plate. Here, the width of the cut central part of the metal plate is set to be slightly larger than the magnetic gap.

Figure 4A:
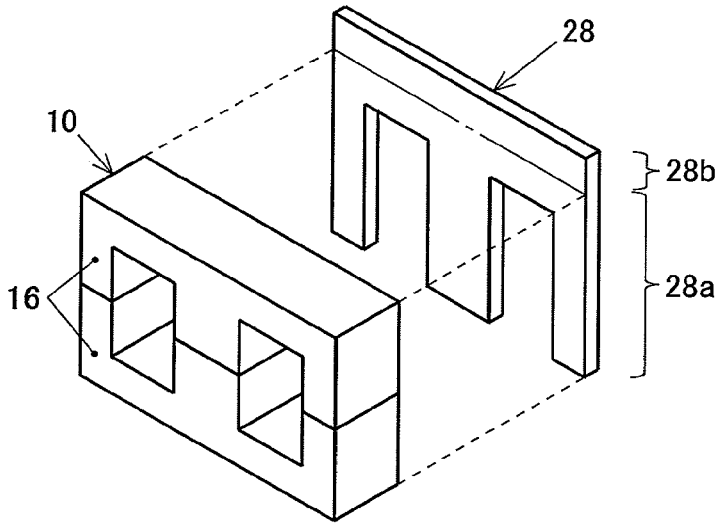
FIG. 4A is an explanatory view illustrating another embodiment of the present invention and is a view illustrating the shapes of the ferrite core and a metal plate.
Figure 4B:
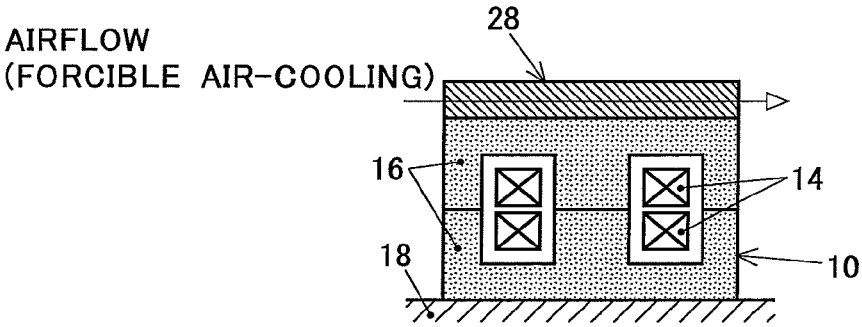
FIG. 4B is a view similar to FIG. 4A but illustrating a state as seen from the side surface of the core.
Figure 4C:
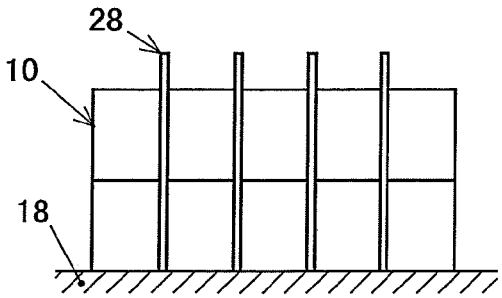
FIG. 4C is a view illustrating a state as seen from a direction perpendicular to the state illustrated in FIG. 4B.

FIG. 4A to FIG. 4C illustrate another embodiment of the present invention. FIG. 4A illustrates the shapes of the ferrite core 10 and a metal plate 28. Here, the ferrite core 10 is made of a combination of an E-shaped core and an E-shaped core like that illustrated in FIG. 1A to FIG. 1C, but may be one with a magnetic gap like that illustrated in FIG. 3A and FIG. 3B. FIG. 4B illustrates a state as seen from the side surface of the core, and FIG. 4C illustrates a state as seen from a direction perpendicular to the side surface of the core. The metal plate 28 is a flat plate in which a comb-shaped insertion part 28*a* corresponding to the shape of the side surface of the ferrite core opposing the metal plate is integrated with an extending part 28*b* where a part of a peripheral part other than a part near the heat radiation structure extends from the periphery of the ferrite core 10. Here, the lower end part of the metal plate 28 is adjacent to the heat radiation structure 18 and the upper end part thereof extends above the upper surface of the core. In FIG. 4B, the production of an airflow in a direction as indicated by an arrow causes the metal plate 28 to be forcibly air-cooled, which can further improve the cooling effect of the inductance device. In addition, the metal plate 28 is formed into a comb shape (that is however directed downward) like that illustrated in FIG. 2A and FIG. 2B, which improves its assemblability.

EXAMPLE

Table 1 illustrates the temperatures of the core obtained when the metal plate (aluminum plate) is inserted into each of the intervals between the adjacent ferrite cores and the winding wire is energized and driven with the configuration illustrated in FIG. 1A to FIG. 1C. Here, the core has a width of 20 mm, the metal plate has a thickness of 1 mm, and the interval between the core and the metal plate is about 0.2 mm. As evident from Table 1, the temperature of the upper surface of the core obtained when the metal plate was inserted could be made lower by about 10° C. than that of the upper surface of the core obtained when the metal plate was not inserted.

TABLE 1

| | Comparative Example (the metal plate was not inserted) | Present Invention (the metal plate was inserted) |
|---|---|---|
| Temperature of the bottom surface of the core $T_0$ | 70° C. | |
| Temperature of the upper surface of the core $T_1$ | 95° C. | 85° C. |
| Temperature Difference $\Delta T = T_1 - T_0$ | 25° C. | 15° C. |

The partial cores constituting each of the ferrite cores may be made of, besides the combination of the E-shaped core and the E-shaped core as in the above embodiments, a combination of an E-shaped core and an I-shaped core, a combination of a U-shaped core and a U-shaped core, a combination of a U-shaped core and an I-shaped core, or the like. The proportion of the thickness of the metal plate to the width of the ferrite core is preferably set in the range of 1/40 to 1/5 and more preferably set in the range of about 1/30 to 1/10, although it depends on the width of the core, a power capacity, a material, or the like. This is because it is difficult to obtain a sufficient radiation effect if the proportion is too small and an increase in the cost as well as the upsizing of the inductance device are caused if the proportion is too large.

INDUSTRIAL APPLICABILITY

According to the present invention, the above configuration causes a substantial heat path cross-sectional area to increase with the insertion of the metal plate into each of the intervals between the ferrite cores, which can efficiently radiate generated heat from the core to the heat radiation structure and reduce an increase in the temperature of the core. In addition, the increase in the temperature of the core can be minimized even if a heating value becomes larger, which is extremely effective in that particularly the downsizing and the cost reduction of the high power inductance device are attained.

REFERENCE SIGNS LIST

10 ferrite core
12 metal plate
14 winding wire
16 E-shaped core
18 heat radiation structure

The invention claimed is

1. A high power inductance device comprising a ferrite magnetic core and a winding wire wound around the ferrite magnetic core, and which is to be mounted on a heat radiation structure through at least one of front surfaces of the ferrite magnetic core, wherein the ferrite magnetic core comprises: a metal plate, and a plurality of ferrite cores having a completely-closed magnetic path structure or a quasi-closed magnetic path structure with a magnetic gap;

the ferrite cores and the metal plate are arranged such that magnetic paths of the ferrite cores are parallel to each other, and such that the metal plate is between the ferrite cores in such a manner that planar faces of the metal plate are in an opposed confronting relation with the ferrite cores and at least one end of the metal plate is to be in an opposed confronting relation with the heat radiation structure;

the winding wire is commonly wound around all the ferrite cores; and the inductance device is to be mounted such that at least one plane surface of peripheral surfaces of each of the ferrite cores is brought into direct or indirect contact with the heat radiation structure.

2. The high power inductance device according to claim 1, wherein each of the ferrite cores is made of a combination of partial cores having bonding surfaces each traversing the magnetic paths.

3. The high power inductance device according to claim 2, wherein at least one of the partial cores constituting each of the ferrite cores is an E-shaped core and the other thereof is the E-shaped core or an I-shaped core, and the winding wire is wound around middle leg part of the E-shaped core.

4. The high power inductance device according to claim 1, wherein the metal plate is a flat plate having a same shape as a shape of a side surface of the ferrite core opposing the metal plate.

5. The high power inductance device according to claim 1, wherein the metal plate is a flat plate in which a comb-shaped insertion part corresponding to a shape of a side surface of the ferrite core opposing the metal plate is integrated with an extending part where a part of a peripheral part other than a part near the heat radiation structure extends from a periphery of the ferrite core.

* * * * *